United States Patent [19]

Jochum

[11] Patent Number: 4,577,793

[45] Date of Patent: Mar. 25, 1986

[54] POWDER CHARGE OPERATED FASTENING ELEMENT SETTING DEVICE

[75] Inventor: Peter Jochum, Meiningen, Austria

[73] Assignee: Hilti Aktiengesellschaft, Fürstentum, Liechtenstein

[21] Appl. No.: 734,037

[22] Filed: May 14, 1985

[30] Foreign Application Priority Data

May 16, 1984 [DE] Fed. Rep. of Germany ..... 3418238

[51] Int. Cl.[4] ..... B25C 1/08

[52] U.S. Cl. ..... 227/10; 227/9

[58] Field of Search ..... 227/8, 9, 10, 11

[56] References Cited

U.S. PATENT DOCUMENTS 3,204,400 9/1965 Kvavle ..... 227/10 X
4,134,527 1/1979 Termet ..... 227/10
4,382,533 5/1983 Buechel et al. ..... 227/10

FOREIGN PATENT DOCUMENTS 0042485 12/1981 European Pat. Off. ..... 227/10

*Primary Examiner*—Paul A. Bell

*Attorney, Agent, or Firm*—Toren, McGeady, Stanger, Goldberg & Kiel

[57] ABSTRACT

A powder charge operated fastening element setting device includes a housing, a barrel forming an axially extending bore with the barrel being axially and rotationally displaceable within the housing. An axially extending driving piston is located in the barrel bore and is axially displaceable therein between a ready-to-fire position and a fired position. A guide bush is located within the housing at the rear end of the barrel and is coextensive with an axially extended part of the barrel. The guide bush is secured against rotation relative to the housing. Propellant gases are generated in combustion chamber in the guide bush and flow into the barrel bore. The force of the propellant gases for propelling the driving piston can be regulated by at least one outlet opening adjacent the rear end of the barrel which can be selectively connected to an outlet flow duct in the guide bushing which opens to the atmosphere. By rotating the barrel the outlet opening can be moved into or out of communication with the outlet flow duct.

7 Claims, 3 Drawing Figures

POWDER CHARGE OPERATED FASTENING ELEMENT SETTING DEVICE

BACKGROUND OF THE INVENTION

The present invention is directed to a powder charge operated setting device for driving fastening elements, such as bolts, nails and the like, into a hard receiving material, such as steel, concrete and the like, comprising a housing, a barrel mounted in the housing, a driving piston displaceably positioned in the barrel, and a guide bush located at and being coextensive with one end of the barrel. The guide bush forms a combustion chamber. The barrel is supported so that it can be rotated within the housing relative to the guide bush and the barrel has at least one outlet flow opening adjacent its rear end and the guide bush has an outlet flow duct which opens through the housing to the atmosphere.

To drive bolts, nails or the like into receiving materials of different hardnesses and strengths, the resistance to be overcome can vary greatly. Accordingly, there is a need for regulating the driving capacity of the device in accordance with the conditions experienced. In known setting devices operated by means of a powder charge, regulation is effected by using different strengths of the powder charge in the form of a cartridge or caseless charge. To avoid the necessary costly storage of the different strength propellant charges, it has been known to use a single strength propellant charge with means in the setting device for regulating propelling force.

In one known setting device, regulation of the propelling force is achieved by releasing some part of the propellant gases into the atmosphere. To regulate the output, the barrel, which is connected to the guide bush by means of screws, is axially offset relative to the guide bush by rotation so that a flow gap is produced between the rear end of the barrel and the inside of the guide bush which encircles it so that a portion of the propellant gases flows through the gap from the combustion chamber into the atmosphere passing through an outlet duct. By varying the size of the gap, the output can be controlled continuously so that the greatest output is achieved when the gap as closed and the output gradually is reduced as the gap is gradually opened.

One disadvantage of this known device is that the propellant charge residue relatively rapidly blocks the gap when it is open for reducing the propellant force because of the small width of the gap and thus alters the adjusted output and causes the barrel to be fixed relative to the guide bush.

SUMMARY OF THE INVENTION

Therefore, the primary object of the present invention is to provide a powder charge operated setting device with regulation of the propelling force which is insensitive to any propellant charge residue and is characterized by continuous functioning efficiency and handling ease.

In accordance with the present invention, outlet openings are provided in the barrel in communication with the combustion chamber when the driving piston is in the ready-to-fire position and the openings can be selectively aligned in communication with the outlet flow duct in the guide bush. With such a setting device it is possible to adjust the propelling force with the maximum force being available when none of the outlet openings are in communication with the outlet flow duct or to provide a reduced propelling force by selectively arranging one of the outlet openings in communication with the outlet flow duct by rotating the barrel. It is advisable to provide an outlet opening for reduced propelling force with the outlet opening being movable into flow communication with the outlet flow duct. With this arrangement, the largest possible cross-sectional clearance for the outlet opening is provided which promotes the free passage of any propellant charge residue out of the device.

Preferably, the driving piston has a sealing shoulder connected to an axial stop at the rear end of the piston facing toward the combustion chamber. The axial stop uncovers the outlet openings when the driving piston is located in the ready-to-fire position. When the driving piston is located in the ready-to-fire position, the propellant gases flow from the combustion chamber to the outlet openings around the axial stop on the piston and flow out through the openings if they are in flow communication with the outlet flow duct. The sealing shoulder on the driving piston assures that the remainder of the propellant gases for driving the piston act entirely on the rear end face of the piston.

The axial stop can be arranged in a number of different ways. In one embodiment the stop can be a hollow cylindrically continuation with a transforce borehole located adjacent to the sealing shoulder. An axial stop in the form of a solid peg with a diameter smaller than the barrel bore has proven particularly simple in terms of production. Accordingly, the propellant gases can flow into the bore in the barrel around the peg and to the outlet openings.

It is advantageous if the axial stop is supported at the guide bush when the driving piston is in the ready-to-fire position. The guide bush which is fixed in the axial direction relative to the barrel has a base penetrated by one or more flow ducts which open into the combustion chamber. In this way, the outlet openings are connected with the combustion chamber when the drive piston is located in the ready-to-fire position. It is also possible, however, to axially support the axial stop of the driving piston at a shoulder in the barrel with the shoulder being formed by a cross-sectional reduction of the barrel bore or by a rear base in the barrel. Again, the base can have a flow duct for the propellant gases from the combustion chamber.

It is preferable if several outlet openings are provided each with a different cross-section for providing different propelling force levels. By rotating the barrel one of the outlet openings can be placed in communication with the outlet flow duct to reduce the propelling force and the propelling force is increasingly reduced as the size of the outlet opening increases. Preferably, the outlet openings are arranged in a circular arc around the barrel with the openings each providing a successively larger cross-section.

The shape of the outlet flow duct can be selected as desired. Advantageously, the outlet flow duct is formed as a groove or channel being elongated in the direction of the barrel axis. The groove can open directly to the atmosphere. An advantage of the outlet flow duct as a groove involves simplicity with regard to production so that any axial displacement of the outlet openings due to tolerances during production have no effect.

According to another feature of the invention, the dimension of the cross section of the outlet flow duct can correspond, at least, to the cross-section of the largest outlet opening. Accordingly, the propelling force regulation is ensured over the full range of the propelling force corresponding to the number of outlet openings of different cross section. Further, due to the size of the outlet flow duct, there is no interference with the flow of the propellant gases so that the likelihood of any deposition of propellant charge material is eliminated.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
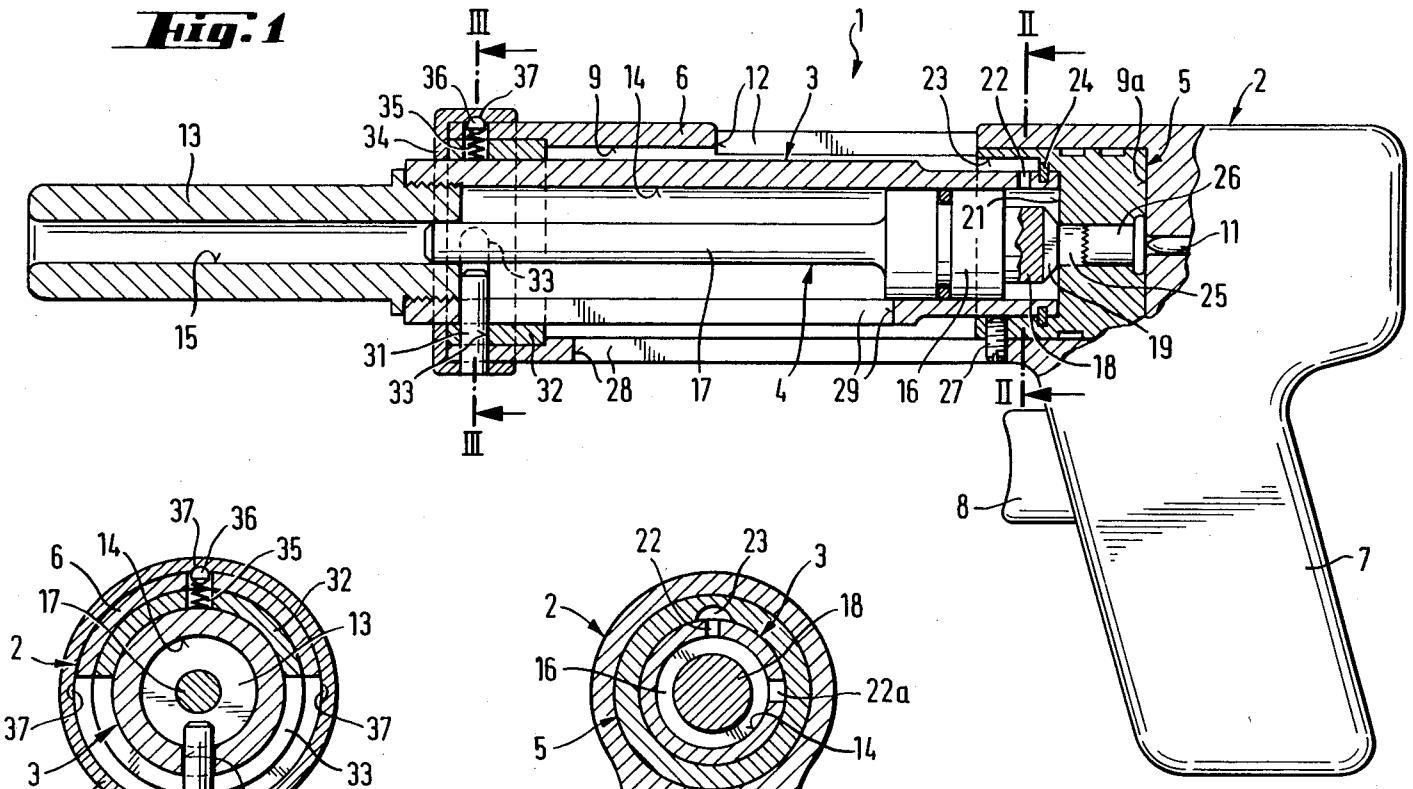
FIG. 1 is a side view, partly in section, of a fastening element setting device embodying the present invention.

A fastening element setting device 1, as shown in FIG. 1, includes a housing 2, a barrel 3 supported within the housing so that it can be displaced axially and rotatably relative to the housing. The barrel has an axially extending bore 14 therethrough with a driving piston 4 axially displaceably mounted within the bore 14. A guide bush 5 is located at the rear or right end of the barrel as viewed in FIG. 1 and is coextensive with and surrounds a portion of the barrel extending from the rear end. The driving piston 4 is axially displaceable between the ready-to-fire position shown in FIG. 1 and a fired position where it is driven forwardly to the left as viewed in FIG. 1.

The housing 2 is made up of a main body 6 and a handle 7 extending downwardly from the main body and a trigger 8 is positioned in the handle for actuating the fastening element setting process in a known manner. The barrel 3 and the guide bush 5 are inserted into a centrally arranged opening 9 in the main body 6 in the rightward direction until the bush rests against base **9*a* in the main body located upwardly from the handle 7. In addition, a firing pin 11 of the firing or ignition mechanism, known per se, is mounted in the housing 2 rearwardly of the bush 5. The upper side of the main body 6 has a window-like opening 12 through which the setting device is loaded with propellant charges when the barrel is pulled forwardly or to the left as viewed in FIG. 1**.

A muzzle tube 13 is screwed into the front end of the barrel 3. The driving piston 4 has a head or sealing shoulder 16 at its rear end with an axially extending shaft projecting forwardly from the shoulder into the muzzle tube 13. The shaft 17 has a reduced cross-section relative to the shoulder 16 so that the shaft is guided within the muzzle tube 13 while the head or shoulder 16 is guided within the bore 14 when it is moved axially relative to the barrel. The bore 15 formed in the muzzle tube 13 is a smaller diameter than the bore 14. An axial stop 18 in the form of a cylindrical peg or post of full or solid cross-section is located at the rear end of the driving piston 4 and projects toward the guide bush 5. The diameter of the stop 18 is considerably smaller than the bore 14 so that an annular space remains between the radially outer surface of the stop 18 and the surface of the bore 14. At its end face closer to the guide bush 5, the stop 18 forms a transverse duct 19. In the ready-to-fire position shown in FIG. 1, the end face of the stop containing the duct 19 bears against the base 21 of the guide bush 5. In the axially extending region of the axial stop 18, the barrel 3 has two outlet openings 22, **22*a* each with a different cross-sectional area spaced apart around the circumference of the barrel, note FIG. 2**.

Figure 2:
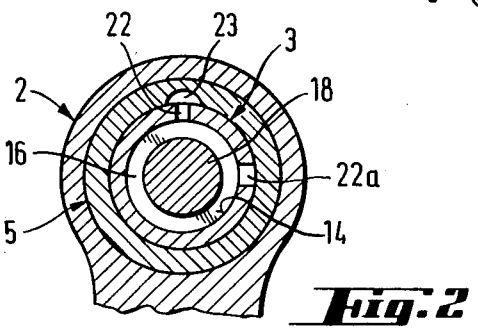
FIG. 2 is a sectional view through the setting device taken along the line II—II in FIG. 1.

In the rotational position of the barrel shown in FIG. 2, outlet opening 22 is in flow communication with an outlet flow duct 23 in the guide bush. The outlet flow duct 23 is in the form of a groove extending in the axial direction exteriorly of the barrel 3. The outlet flow duct opens into the atmosphere via the opening 12 in the housing. Guide bush 5 is axially fixed to the barrel by a snap ring 24. A combustion chamber 25 located in the guide bush 5 opens to the rear end of the bore 14 in the barrel 3 and, as shown in FIG. 1, a propellant charge in the form of a cartridge 26 is fitted into the combustion chamber. The non-rotatable support of the guide bush 5 relative to the housing 2 is afforded by a securing pin 27 which is threaded into guide bush and projects outwardly into an elongated slot 28 in the housing tube.

The barrel 3 has a slot 29 elongated in the axial direction of the barrel and the slot is arranged to receive a pin 31 extending transversely of the barrel axis. The pin also extends through the main body 6 of the housing and through a bearing bush 32, provided for assembly reasons, in the region of a circumferential slot 33, note FIG. 3. Pin 31 is fixed at its outer end in an actuating ring 34 which is rotatably supported on the main body 6. On one hand, the pin 31 serves as a restoring or returning member for the driving piston 4 and, therefore, projects into the bore 14 in front of the head or sealing shoulder 16. On the other hand, the pin is used to rotate the barrel 3 by rotating the actuating ring 34.

To return the driving piston 4 from the fired position after a fastening element has been driven in, the barrel 3 is pulled forwardly in the driving direction and the pin 31 engages in front of the head or sealing shoulder 16 of the driving piston 4 and holds the piston while the barrel is axially displaced. During the movement of the driving piston 4 the axial stop 18 contacts the base 21 of the guide bush 5 and the piston is positioned in the ready-to-fire position in the barrel 3. The ready-to-fire position illustrated in FIG. 1 is reached by pushing rearwardly on the unit formed by the barrel 3 in the driving piston 4.

In the driving-in process, cartridge 26 is ignited and the propellant gases generated within the combustion chamber 25 flow into the bore 14 through the transverse duct 19. In the arrangement shown in FIG. 1, a part of the propellant gases pass through the outlet opening 22 into the outlet flow duct 23 and then flow into the atmosphere through the opening 12. Accordingly, a reduced driving or propulsion force is directed against the driving piston for carrying out the driving-in process.

By rotating the barrel 3 relative to the housing 2 and the guide bush 5, either the second outlet opening **22*a* or no outlet opening is arranged in communication with the outlet flow duct 23. If the second outlet flow opening 22*a* is in communication with the outlet flow duct 23, the driving force is greatly reduced because of the increased cross-section of the opening 22***a*. In the other rotational position where there is no outlet opening leading to the outlet flow duct 3, all of the propellant gases are directed against the driving piston and the maximum driving-in force is provided.

Figure 3:
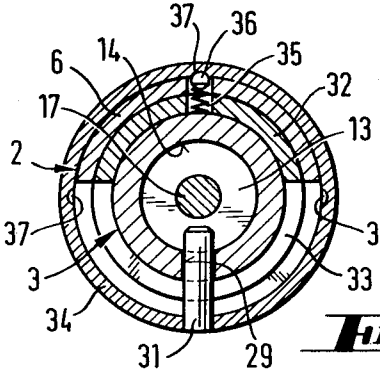
FIG. 3 is a cross-sectional view of the setting device taken along the line III—III in FIG. 1.

The rotational positions of the barrel corresponding to the different levels of the propelling force are maintained by the corresponding locking positions of the actuating ring 34, as shown in FIG. 3. For this purpose, a locking ball 36 is used which is biased by a spring 35 into one of the catch recesses 37 formed in the actuating ring. The different levels of driving force or propelling force can be indicated by visual markings provided between the actuating ring 34 and the main body 6.

While specific embodiments of the invention have been shown and described in detail to illustrate the application of the inventive principles, it will be understood that the invention may be embodied otherwise without departing from such principles.

I claim:

1. Powder charge operated setting device for driving fastening elements, such as bolts, nails and the like, into a hard receiving material, comprising a housing, a barrel located within said housing and having an axially extending bore therethrough, said barrel having a front end and a rear end, an axially extending driving piston mounted within said bore in said barrel and being axially displaceable therein, said piston having a front end and a rear end, said driving piston being axially displaceable between a ready-to-fire position with the rear end of said piston located in the rear end of said barrel and a fired position with the rear end of said piston displaced axially toward the front end of said barrel, a guide bush located in said housing at the rear end of said barrel and being coextensive with and laterally enclosing an axially extending portion of said barrel extending from the rear end thereof, said guide bush forming a combustion chamber in communication with said bore in said barrel, said barrel is rotatably supported in said housing for rotational displacement relative to said guide bush, wherein the improvement comprises that said barrel has at least one outlet opening extending therethrough adjacent the rear end thereof and in the region where said barrel and said guide bush are coextensive, said guide bush has an outlet flow duct in communication with the atmosphere exterior of said housing, said at least one outlet opening in said barrel is selectively placeable into and out of flow communication with said outlet flow duct in said guide bush when said driving piston is in the ready-to-fire position for regulating the power output of the powder charge directed against said driving piston.

2. Powder charge operated setting device, as set forth in claim 1 wherein said driving piston has a sealing shoulder located at the rear end thereof, an axial stop extending from said sealing shoulder toward said combustion chamber, and said axial stop being arranged to permit flow from said combustion chamber to said outlet openings in said barrel when said driving piston is in the ready-to-fire position.

3. Powder charge operated setting device, as set forth in claim 2 wherein said axial stop is a solid peg-like member having a diameter smaller than the diameter of said bore in said barrel.

4. Powder charge operated setting device, as set forth in claim 2 or 3, wherein said axial stop is supported on said guide bush when said driving piston is in the ready-to-fire position.

5. Powder charge operated setting device, as set forth in claim 1, 2 or 3, wherein said at least one outlet opening includes a plurality of said outlet openings spaced circumferentially apart around said barrel with each said outlet opening having an opening of a different cross-sectional area.

6. Powder charge operated setting device, as set forth in claim 1, 2 or 3, wherein said outlet flow duct is an elongated groove extending parallel to the axis of said barrel.

7. Powder charge operated setting device, as set forth in claim 6 wherein the transverse cross-sectional area of said outlet flow duct corresponds at least to the transverse cross-sectional area of the largest of said outlet openings.

* * * * *